US007043183B2

(12) United States Patent
Yoda et al.

(10) Patent No.: US 7,043,183 B2
(45) Date of Patent: May 9, 2006

(54) IMAGE FORMING APPARATUS

(75) Inventors: Yasuo Yoda, Shizuoka (JP); Kenichi Iida, Boise, ID (US); Hisahiro Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 18 days.

(21) Appl. No.: 10/626,534

(22) Filed: Jul. 25, 2003

(65) Prior Publication Data

US 2004/0208678 A1 Oct. 21, 2004

(30) Foreign Application Priority Data

Jul. 30, 2002 (JP) ..... 2002-221515

(51) Int. Cl.
*G03G 15/16* (2006.01)

(52) U.S. Cl. ..... 399/302; 399/308

(58) Field of Classification Search ..... 399/302, 399/159, 162, 308
See application file for complete search history.

(56) References Cited

U.S. PATENT DOCUMENTS 5,807,651 A * 9/1998 Rimai et al. ..... 430/11
6,246,845 B1 * 6/2001 Hosoya et al. ..... 399/66
6,253,038 B1 * 6/2001 Ito et al. ..... 399/50
6,397,034 B1 * 5/2002 Tarnawskyj et al.
2001/0026709 A1 * 10/2001 Hara et al. ..... 399/174
2001/0028815 A1 * 10/2001 Sato ..... 399/223
2002/0164177 A1 * 11/2002 Watanabe et al. ..... 399/237

FOREIGN PATENT DOCUMENTS

JP 10-698 1/1998

* cited by examiner

*Primary Examiner*—Sophia S. Chen
(74) *Attorney, Agent, or Firm*—Fitzpatrick, Cella, Harper & Scinto

(57) ABSTRACT

The image forming apparatus has an image bearing member bearing an image thereon, and a transfer member contacting with the image bearing member in a contact portion, the image on the image bearing member is transferred to a transfer medium in the contact portion by the transfer member, the Young's modulus of the image bearing member is equal to or greater than $2\times10^8$ [N/m$^2$] and equal to or less than $9\times10^9$ [N/m$^2$] and contact pressure P between the image bearing member and the transfer member is equal to or greater than $4.0\times10^4$ [N/m$^2$] and equal to or less than $7.3\times10^4$ [N/m$^2$]. Thereby, there is provided an image forming apparatus which prevents the deterioration of an image even if use is made of an image bearing member of high hardness.

5 Claims, 3 Drawing Sheets

IMAGE FORMING APPARATUS

BACKGROUND OF THE INVENTION

1. Field of the Invention

This invention relates to an image forming apparatus such as a copying machine or a printer, and particularly to an apparatus for transferring an image on an image bearing member to a transfer material.

2. Description of Related Art

FIG. 4 of the accompanying drawings shows an image forming apparatus which is the background art of the present invention.

This image forming apparatus has a plurality of photosensitive drums 111*a*, 111*b*, 111*c* and 111*d* as first image bearing members corresponding to developers (toners) of the first color: yellow, the second color: magenta, the third color: cyan, and the fourth color: black, and an intermediate transferring belt 101 as a second image bearing member, and the intermediate transferring belt 101 is in contact with each of the photosensitive drums 111*a*–111*d* in respective primary transferring parts.

The photosensitive drums 111*a*–111*d* are disposed along the direction of movement of the intermediate transferring belt 101 in the order of the photosensitive drum 111*a* for the first color (yellow) located most upstream, the photosensitive drum 111*b* for the second color (magenta) located nearest to and downstream of the photosensitive drum 111*a*, the photosensitive drum 111*c* for the third color (cyan) located nearest to and downstream of the photosensitive drum 111*b*, and the photosensitive drum 111*d* for the fourth color (black) located nearest to and downstream of the photosensitive drum 111*c*.

Also, the intermediate transferring belt 101 is located at a predetermined process speed in synchronism with the photosensitive drums 111*a*–111*d*.

The photosensitive drums 111*a*, 111*b*, 111*c* and 111*d* are uniformly charged by contact charging rollers 112*a*, 112*b*, 112*c* and 112*d*, respectively, and electrostatic latent images are formed on the surfaces thereof by laser beams from scanners 113*a*, 113*b*, 113*c* and 113*d* modulated by an image information signal sent from a host computer.

These electrostatic latent images reach portions opposed to developing devices 114*a*, 114*b*, 114*c* and 114*d* by the rotation of the photosensitive drums 111*a*–111*d*, and are supplied with toner charged to the same polarity (the minus polarity in this example) as that of the surfaces of the photosensitive drums 111*a*–111*d*, and are visualized thereby and become developer images (toner images). The developing devices 114*a*–114*d* provided for the respective photosensitive drums 111*a*–111*d* are of a two-component developing type, and perform their developing operation by a developing bias comprising an AC voltage superimposed on a DC voltage being applied thereto.

The toner images formed on the respective photosensitive drums 111*a*–111*d* are transferred onto the intermediate transfer belt 101 by a primary transferring bias being applied from primary transferring bias sources 116*a*, 116*b*, 116*c* and 116*d* to primary transferring rollers 115*a*, 115*b*, 115*c* and 115*d*, respectively, which are in contact with the back of the intermediate transferring belt 101, in respective primary transferring nips formed by and between the intermediate transferring belt 101 and the photosensitive drums 111*a*–111*d*. At a stage whereat the intermediate transfer belt 101 has passed the primary transferring nip between it and the photosensitive drum 111*d*, the formation of a four-color image on the intermediate transferring belt 101 is terminated, and a primary transferring step is completed.

Next, a transfer material M is taken out of feeding means, not shown, and is inserted into a secondary transferring nip portion formed by a separation roller 101*c* and a secondary transferring roller 102 as a transferring member being brought into pressure contact with each other with the intermediate transferring belt 101 interposed therebetween. At this time, a bias opposite in polarity to the toners is applied to the secondary transferring roller 102 by a secondary transferring bias source 121, whereby the toner image is secondary-transferred from the intermediate transferring belt 101 to the transfer material M.

The transfer material M bearing the unfixed toner image thereon and having left the secondary transferring nip portion arrives at a fixing apparatus 103, and is heated and pressurized thereby, whereby a permanent fixed image is obtained.

Each of the photosensitive drums 111*a*–111*d* has an outer diameter of 30.0 mm and has a layer having a photosensitive material applied thereto on an aluminum cylinder.

The intermediate transferring belt 101, as shown in FIG. 2, is passed over three rollers contained in the intermediate transferring belt 101, i.e., a drive roller 101*a*, a supporting roller 101*b* and a separation roller 101*c*.

As the intermediate transferring belt 101, carbon is dispersed in polyimide and the surface resistivity ρs thereof is adjusted to medium resistance of $1\times10^{12}$ Ω/□, whereby charges added to the belt with the transferring step or the like can be attenuated without providing any special residual charge eliminating mechanism. Also, the intermediate transferring belt 101 is a single-layer endless belt having a circumferential length of 1000 mm and a thickness of 100 μm.

Each of the drive roller 101*a*, the supporting roller 101*b* and the separation roller 101*c* over which the intermediate transferring belt 101 is passed is a roller having an outer diameter of 29.8 mm and comprised of an aluminum mandrel having a diameter of 24.0 mm and an elastic layer having a layer thickness 2.9 mm. Also, the secondary transferring roller 102 is a roller having an outer diameter 33.0 mm and comprised of an aluminum mandrel having a diameter of 14.0 mm and a rubber layer having a layer thickness of 9.5 mm, and the hardness of this roller is 26° (Asker-C).

The intermediate transferring belt 101 in the present example is of a single-layer construction in which Young's modulus E is $6\times10^9$ N/m$^2$. Also, the contact pressure P [N/m$^2$] of the secondary transferring roller 102 in the present example relative to the intermediate transferring belt 101 is $3.3\times10^4$ N/m$^2$.

The contact pressure P is given as P=F/(L×W) from the lengthwise width L [m] of the secondary transferring roller 102, the nip width W [m] between the intermediate transferring belt 101 and the secondary transferring roller 102, and the contact force F [N] of the secondary transferring roller 102 relative to the intermediate transferring belt 101.

Also, the nip width W was obtained by applying ink to the intermediate transferring belt 101 and bringing the secondary transferring roller 102 into contact therewith, and measuring the trace of the ink adhering to the secondary transferring roller 102. The nip width W was determined from the average of the widths of the trace of the ink measured at five points in total, i.e., the center of the roller, points of 50 mm from the center toward the right and left lengthwise ends, and a point of 100 mm from the center toward the right and left lengthwise ends. In the present example, L=0.30 m, F=50 N, and W=0.0050 m.

In the above-described image forming apparatus of the electrophotographic type, the stabilization of the conveyance of the transfer material in the secondary transferring step is achieved by securing a wide nip width of 5.0 mm of the secondary transferring roller 102 by the use of a roller of low hardness of 26° (Asker-C) as the secondary transferring roller 102, and prevents the occurrence of a faulty image attributable to the conveyance shock of the transfer material.

On the other hand, a material of high hardness which the Young's modulus E is $6\times10^9$ N/m$^2$ is used for the intermediate transferring belt 101 to thereby prevent the destruction of the belt due to the fracture thereof, thereby achieving an intermediate transferring belt having a long life.

Now, when the intermediate transferring belt 101 of high hardness is used as described above, if a roller of low hardness is used as the secondary transferring roller 102, the nip width becomes liable to widen and therefore, this has led to a case where the contact pressure P of the secondary transferring roller 102 assumes a low value and the color unevenness of an image attributable to the secondary transferring step is caused.

This color unevenness caused during the secondary transferring step is considered to be attributable to the unevenness of the surface of the transfer material.

That is, the surface of the transfer material M and the surface of the intermediate transferring belt 101 cannot uniformly contact with each other due to the unevenness of the surface of the transfer material M and the high hardness of the intermediate transferring belt 101 and therefore, depending on locations, air gaps exist between the surface of the transfer material M and the surface of the intermediate transferring belt 101.

At locations whereat air gaps exist between the toner layer on the intermediate transferring belt 101 and the surface of the transfer material, a transferring electric field originally applied to only the toner layer is divided by an air layer, whereby the electric field applied to the toner layer is weakened, and the amount of toners residual on the intermediate transferring belt 101 becomes great. This is because unless the reversal of the polarity of the toners occurs, the amount of toners transferred from the intermediate transferring belt 101 to the transfer material M becomes greater when the transferring electric field applied to the toner layer is greater.

It is considered that if as described above, the contact state between the surface of the transfer material M and the surface of the intermediate transferring belt 101 is partly non-uniform, the untransferred toners also become non-uniform. The difference by the portions of the toners not secondary-transferred at this secondary transferring step is considered to be the cause of the occurrence of the uneven colors of an image.

Consequently, in the above-described example, a roller of low hardness is adopted as the secondary transferring roller 102, whereby the contact pressure P assumes a low value and it becomes difficult for the unevenness of the surface of the transfer material M to follow the surface of the intermediate transferring belt 101, whereby the contact state between the surface of the transfer material M and the intermediate transferring belt 101 becomes non-uniform and the residual toners on the intermediate transferring belt 101 also become non-uniform and therefore, the uneven colors are considered to occur.

SUMMARY OF THE INVENTION

It is an object of the present invention to provide an image forming apparatus which prevents the deterioration of an image even if it uses an image bearing member of high hardness.

It is another object of the present invention to provide an image forming apparatus which is provided with an image bearing member bearing a toner image; an intermediate transfer member which is movable in a moving direction and contacts the image bearing member at a contact portion; a cleaning member opposed to the movable intermediate transfer member, for cleaning toner on the intermediate transfer member; and a charge elimination member opposed to the intermediate transfer member and positioned upstream of the contact portion and downstream of the cleaning member in the moving direction of the intermediate transfer member, wherein the toner image on the image bearing member is transferred to a transfer material by the intermediate transfer member, the Young's modulus of the image bearing member is equal to or greater than $2\times10^8$ [N/m$^2$] and equal to or less than $9\times10^9$ [N/m$^2$], and a contact pressure between the image bearing member and the transfer member in the contact portion is equal to or greater than $4.0\times10^4$ [N/m$^2$] and equal to or less than $7.3\times10^4$ [N/m$^2$].

It is another object of the present invention to provide an image forming apparatus which is provided with an image bearing member bearing an a toner image; an intermediate transfer member which is movable in a moving direction and contacts the image bearing member at a contact portion; a cleaning member opposed to the movable intermediate transfer member, for cleaning toner on the intermediate transfer member: and a charge elimination member opposed to the intermediate transfer member and positioned upstream of the contact portion and downstream of the cleaning member in the moving direction of the intermediate transfer member, for executing a charge elimination of the intermediate transfer member, wherein the toner image on the image bearing member is transferred to a transfer material by the intermediate transfer member. A surface resistivity of the image bearing member is equal to or greater than $1\times10^8$ Ω/□ and equal to or less than $1\times10^{15}$ Ω/□, and a contact pressure between the image bearing member and the transfer member in the contact portion is equal to or greater than $4.0\times10^4$ [N/m$^2$] and equal to or less than $3\times10^4$ [N/m$^2$].

Further objects of the present invention will become apparent from the following description.

DESCRIPTION OF THE PREFERRED EMBODIMENTS

Figure 1:
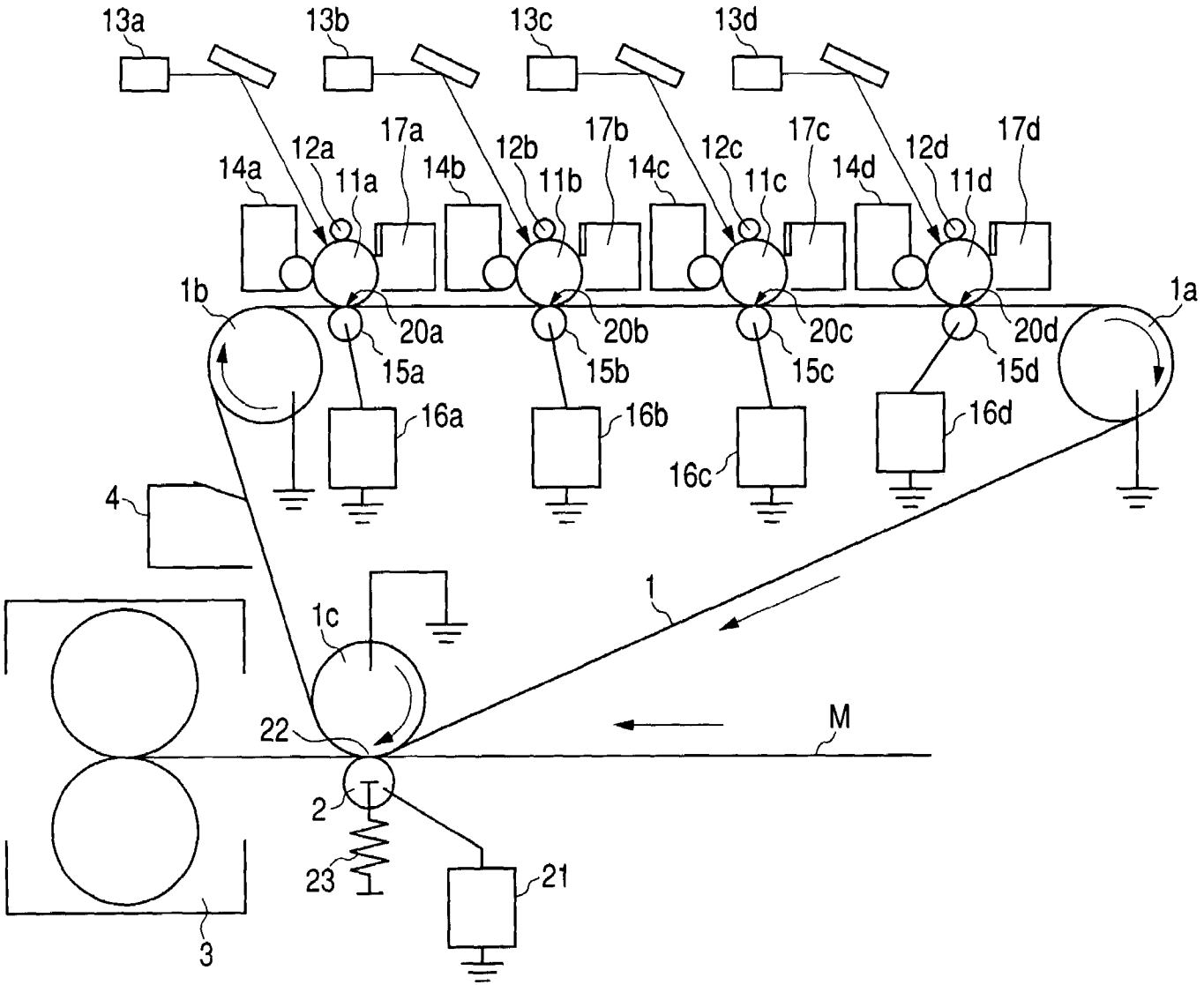
FIG. 1 shows an image forming apparatus which is an embodiment of the present invention.

An image forming apparatus which is an embodiment of the present invention will hereinafter be described in detail with reference to the drawings.

First Embodiment

The construction of an image forming apparatus according to the present embodiment will first be described with reference to a schematic cross-sectional view of a full-color electrophotographic image forming apparatus shown in FIG. 1.

The image forming apparatus has a plurality of photosensitive drums 11*a*, 11*b*, 11*c* and 11*d* as first image bearing members corresponding to color toners of a first color: yellow, a second color: magenta, a third color: cyan, and a fourth color: black, and an intermediate transferring belt 1 as a second image bearing member which is in contact with the photosensitive drums 11*a*–11*d* in their respective primary transferring parts.

The photosensitive drums 11*a*–11*d* are disposed along the direction of movement of the intermediate transferring belt 1 in the order of the photosensitive drum 11*a* for the first color (yellow) located on the most upstream side, the photosensitive drum 11*b* for the second color (magenta) located nearest to and downstream of the photosensitive drum 11*a*, the photosensitive drum 11*c* for the third color (cyan) located nearest to and downstream of the photosensitive drum 11*b*, and the photosensitive drum 11*d* for the fourth color (black) located nearest to and downstream of the photosensitive drum 11*c*.

Each of the photosensitive drums 11*a*–11*d* in the present embodiment has an outer diameter of 30.0 mm and has on an aluminum cylinder a layer having a photosensitive material applied thereto.

As the intermediate transferring belt 1 which is an image bearing member, use can be made of an elastomer sheet or the like having plural-layer structure comprising a resin layer formed as a mold releasing layer on the toner carrying member surface side of resin film of urethane resin, fluorine resin, nylon resin, polyimide resin or the like, resin film consisting of one of these resins having carbon or electrically conductive powder dispersed therein to thereby effect resistance adjustment, or a base layer sheet of urethane rubber, NBR or the like.

The intermediate transferring belt 1 used in the present embodiment is one in which carbon is dispersed in polyimide and surface resistivity ρs has been adjusted to medium resistance of $1\times10^{12}$ Ω/□, and charges imparted to the intermediate transferring belt 1 at a transferring step or the like can be attenuated without any special residual charge eliminating mechanism being provided. This intermediate transferring belt 1 is a single-layer endless belt having a circumferential length of 1000 mm and a thickness of 100 μm.

Surface resistivity measurement was carried out by making electrically conductive rubber into an electrode in conformity with Japanese Industrial Standard JIS-K6911 to thereby obtain a good contacting property between the electrode and the surface of the belt, and in addition, using a super-high resistance ohmmeter (R8340 produced by Advantest Co.). Measurement conditions were applied voltage=100 V and application time=30 s.

Also, the Young's modulus E of the intermediate transferring belt 1 in the present embodiment is high hardness of $9\times10^{9}$ N/m$^2$, whereby fracture or creep of the belt is prevented and a longer life is achieved.

The measurement of the Young's modulus was based upon the tension elastic modulus measuring method of JIS-K7127, and the thickness of a measurement sample was 100 μm.

The intermediate transferring belt 1 is endless as shown in FIG. 1, and is passed over three rollers contained in the intermediate transferring belt 1, i.e., a drive roller 1*a*, a supporting roller 1*b* and a separation roller 1*c*. The drive roller 1*a*, the supporting roller 1*b* and the separation roller 1*c* are electrically grounded. The separation roller 1*c* is an opposed member (roller) opposed to a secondary transferring roller 2 with the intermediate transferring belt 1 interposed therebetween, and supports the intermediate transferring belt 1.

Each of the drive roller 1*a*, the supporting roller 1*b* and the separation roller 1*c* is a roller having an outer diameter of 29.8 mm and comprised of an aluminum mandrel having a diameter of 24.0 mm and a hydrin rubber layer having a layer thickness of 2.9 mm, and the roller resistance value thereof, is rendered into $1\times10^{6}$ Ω by the hydrin rubber being resistance adjusted.

The roller resistance value was measured with the roller which is the object of measurement brought into contact with an aluminum cylinder having a diameter of 30 mm and being driven to rotate relative to the aluminum cylinder, and by using a super-high resistance ohmmeter (R8340 produced by Advantest Co.). Measurement conditions were applied voltage=100 V, application time=30 s, contacting force=9.8 N, and rotational peripheral velocity=117 mm/s.

The intermediate transferring belt 1 is rotated in synchronism with the photosensitive drums 11*a*–11*d* at a predetermined process speed (in the present embodiment, 117 mm/s) by the drive roller 1*a*. The photosensitive drums 11*a*–11*d* are uniformly charged by respective contact charging rollers 12*a*, 12*b*, 12*c* and 12*d*, and electrostatic latent images are formed thereon by laser beams from respective scanners 13*a*, 13*b*, 13*c* and 13*d* modulated by an image information signal transmitted from a host computer.

The intensity and application spot diameter of the laser beams are set properly by the resolution and desired image density of the image forming apparatus, and the electrostatic latent images on the photosensitive drums 11*a*–11*d* are formed by portions to which the laser beams are applied being held at light portion potential VL (about −150V), and portions which are not so being held at dark portion potential VD (about −650V) charged by the respective contact charging rollers 12*a*–12*d* which are primary chargers.

The electrostatic latent images reach portions opposed to respective developing devices 14*a*–14*d* by the rotation of the respective photosensitive drums 11*a*–11*d*, and are supplied with developers (toners) charged to the same polarity (in the present embodiment, the minus polarity) as the surfaces of the photosensitive drums and are visualized thereby, and developer images (toner images) are formed on the photosensitive drums.

The developing devices 14*a*–14*d* in the present embodiment are developing apparatuses adopting a two-component developing process. Also, a developing bias in the present embodiment is a bias voltage comprising an AC voltage superimposed on a DC voltage of a DC component=−400 V, an AC component=1.5 $kV_{pp}$, a frequency=3 kHz and a waveform=rectangular wave.

The toner images formed on the photosensitive drums 11*a*–11*d* are transferred onto the intermediate transferring belt 1 by a primary transferring bias (in the present embodiment, constant current control of +15 μA) being applied from primary transferring bias sources 16*a*–16*d* to primary transferring rollers 15*a*, 15*b*, 15*c* and 15*d*, respectively, which are in contact with the back of the intermediate transferring belt 1 at respective primary transferring nips 20*a*–20*d* which are proximate or contact portions between the intermediate transferring belt 1 and the photosensitive drums 11*a*–11*d*. At a stage whereat the intermediate transferring belt 1 has passed the primary transferring nip 20*d* with the photosensitive drum 11*d*, the formation of a four-color image on the intermediate transferring belt 1 is terminated, and the primary transferring step is completed.

On the other hand, the surfaces of the photosensitive drums 11*a*–11*d* from which the primary transfer of the toner images has been terminated are cleaned by primary-untransferred toners, etc. being removed by drum cleaning devices 17*a*, 17*b*, 17*c* and 17*d* comprising urethane rubber blades, and become ready for the next image forming step.

Next, a transfer material (recording material) M which is a transfer medium is taken out of feeding means, not shown, and the transfer material M is inserted into a secondary transferring nip part 22 by the separation roller 1*c* and the secondary transferring roller 2 as a transfer member being brought into pressure contact with each other with the intermediate transferring belt 1 interposed therebetween. The reference numeral 23 designates pressing means such as a spring, and the secondary transferring roller 2 presses the separation roller 1*c* by this pressing means 23 with the belt 1 interposed therebetween. The secondary transferring nip part 22 is a contact portion in which the intermediate transferring belt 1 and the secondary transferring roller 2 contact with each other.

At this time, a bias opposite in polarity to the toners (in the present embodiment, constant current control of +30 μA) is applied to the secondary transferring roller 2 by a secondary transferring bias source 21, and the toner image is secondary-transferred from the intermediate transferring belt 1 to the transfer material M.

The transfer material M bearing the unfixed toner image thereon which has passed through the secondary transferring nip part 22 reaches a fixing device 3, and is heated and pressurized, whereby a permanent fixed image is obtained. The surface of the intermediate transferring belt 1 from which the toner image has been transferred to the transfer material M has any secondary-untransferred toners thereon removed by an intermediate transferring member cleaner 4 having a cleaning blade made of urethane rubber.

As described above, the intermediate transferring belt 1 used in the present embodiment is one in which carbon is dispersed in polyimide to thereby adjust the surface resistivityρs ρs to medium resistance of $1\times10^{12}$ Ω/□, and charges imparted to the belt 1 at the transferring step or the like can be attenuated without any special residual charge eliminating mechanism being provided, and the Young's modulus E is high hardness of $9\times10^{9}$ N/m$^2$, whereby fracture or creep of the belt is prevented and a longer life is achieved.

The secondary transferring roller 2 in the present embodiment is a roller having an outer diameter of 22.0 mm comprised of an aluminum mandrel having a diameter of 14.0 mm and a foamed hydrin rubber layer having a layer thickness of 4 mm, and hydrin rubber is resistance-adjusted to thereby render the roller resistance value into $1\times10^{8}$ Ω. Also, as the secondary transferring roller 2, use is made of a roller of somewhat low hardness of 35° (Asker-C), and the nip width of the secondary transferring roller 2 is widened to thereby prevent a faulty image attributable to the conveyance shock of the transfer material.

That is, the image forming apparatus according to the present embodiment uses image bearing members of high hardness and a transfer member of low hardness, and improves the performance of the conveyability of the transfer material and realizes a longer life, but as described in connection with the background art, such as image forming apparatus having the transfer member of low hardness and the image bearing members of high hardness becomes low in the contact pressure of the transfer member and therefore is liable to cause the color unevenness of an image.

Figure 2:
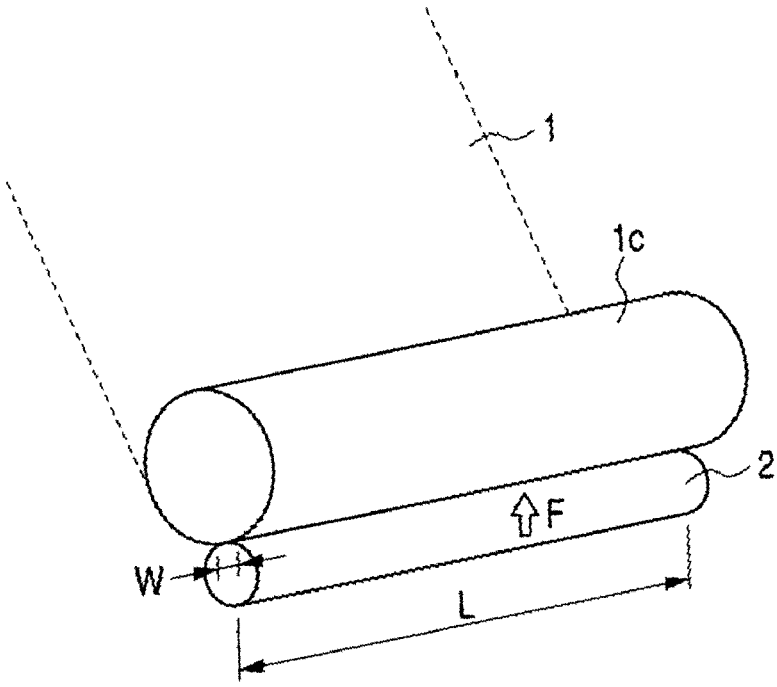
FIG. 2 is a perspective view of a secondary transferring part.
Figure 3:
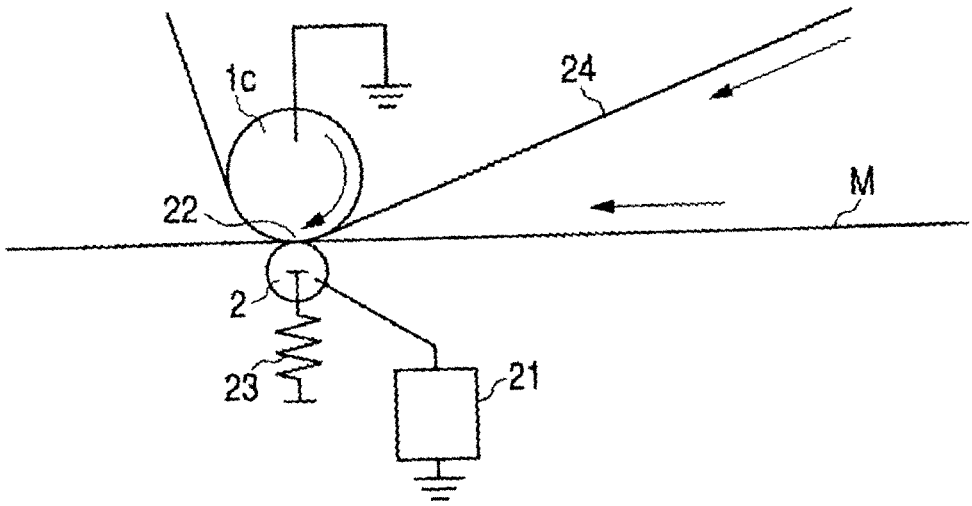
FIG. 3 shows a secondary transferring part in another embodiment.

In the present embodiment, the contact pressure P [N/m$^2$] of the secondary transferring roller 2 against the intermediate transferring belt 1 is $4.8\times10^{4}$ N/m$^2$. The contact pressure P is given as P=F/(L×W) from the lengthwise width L [m] of the secondary transferring roller 2, the nip width W [m] between the intermediate transferring belt 1 and the secondary transferring roller 2 and the contacting force F [N] of the secondary transferring roller 2 against the intermediate transferring belt 1 (see FIG. 2).

Also, the nip width W is obtained by applying ink to the intermediate transferring belt 1 and bringing the secondary transferring roller 2 into contact therewith, and measuring the trace of the ink adhering to the secondary transferring roller 2. As the measuring method, the nip width W was determined from the average of the measurements of the width of the ink trace at five points in total, i.e., the center of the roller, points of 50 mm from the center toward the right and left lengthwise ends, and points of 100 mm from the center toward the right and left lengthwise ends. In the present embodiment, L was set to L=0.30 m, F was set to F=80 N, and W was 0.0056 m.

Here, an effect in the present embodiment is confirmed by Experimental Examples 1 to 7 in which various conditions were changed. Experimental Examples 1 to 7 are ones in which the contact pressure P [N/m$^2$] of the secondary transferring roller against the intermediate transferring belt and the numerical value of the Young's modulus of the intermediate transferring belt were changed. Experimental Example 4 is the present embodiment (the first embodiment).

The contact pressure P was changed from $2.7\times10^{4}$ to $8.0\times10^{4}$ [N/m$^2$]. The contact pressure P was changed by changing the contacting force F [N] from 30 to 100 [N], and further changing the material hardness of the rubber layer of the secondary transferring roller, and changing the nip width W by the use of two levels of roller hardness, i.e., 35° and 49° (Asker-C).

Table 1 below shows a list of the setting of the contacting force F, the nip width W and the secondary transferring roller hardness corresponding to the contact pressure P in the respective experimental examples. These numerical values were measured by the measuring method in the above-described first embodiment.

TABLE 1

| | Secondary Transferring Roller Hardness [°] (Asker-C) | Contacting Force F [N] | Transferring Nip Width W [mm] | Contact Pressure P [N/m$^2$] |
|---|---|---|---|---|
| Experimental Example 1 | 35 | 30 | 3.4 | $2.7\times10^{4}$ |
| Experimental Example 2 | 35 | 50 | 4.5 | $3.5\times10^{4}$ |
| Experimental Example 3 | 35 | 60 | 5.0 | $4.0\times10^{4}$ |
| Experimental Example 4 | 35 | 80 | 5.6 | $4.8\times10^{4}$ |
| Experimental Example 5 | 49 | 70 | 4.0 | $6.2\times10^{4}$ |
| Experimental Example 6 | 49 | 90 | 4.8 | $7.3\times10^{4}$ |
| Experimental Example 7 | 49 | 100 | 5.1 | $8.0\times10^{4}$ |

On the other hand, in these conditions, the Young's modulus of the intermediate transferring belt was changed from $4\times10^6$ to $9\times10^9$ [N/m$^2$] by changing the material of the intermediate transferring belt.

In respective ones of Experimental Examples 1 to 7, as the above-described intermediate transferring belt, there were mounted (1) one having a Young's modulus E of $9\times10^9$ N/m$^2$ in which carbon was dispersed in polyimide, (2) one using a material of polyvinylidene fluoride (PVDF) having a Young's modulus of $2\times10^8$ N/m$^2$, and (3) one using a material of polyether sulfon (PES) having a Young's modulus of $2\times10^9$ N/m$^2$.

In addition, particularly about a belt material of low Young's modulus, the expansion and contraction or creep of the belt occurs to a single layer, whereby image magnification is unstable and the belt is weak to fracture and the life thereof is short, whereby the belt does not satisfy the function as the intermediate transferring belt and therefore, (4) a belt made into two-layer structure by spray-coating a rubber sheet of NBR having a thickness of 3 mm with urethane resin (urethane resin coat) was used and mounted in respective image forming apparatuses. The Young's modulus of the urethane resin layer is $4\times10^6$ N/m$^2$.

The PVD belt under item (2) and the PES belt under item (3) were formed into single-layer endless belts having a circumferential length of 1000 mm and a thickness of 100 μm by dispersing carbon to thereby adjust the surface resistivity ρs to ρs=$1\times10^{12}$ Ω/□. Also, the urethane resin coat belt under item (4) was formed into a two-layer endless belt having surface resistivity ρs of $1\times10^{12}$ Ω/□ on the toner bearing surface side and having a circumferential length of 1000 mm and a thickness of 500 μm by dispersing carbon to thereby adjust the volume resistivity of NBR to $1\times10^6$ Ω*cm, and coating NBR with urethane resin having volume resistivity of $1\times10^9$ Ω*cm to 30 μm.

In each experimental example, the dependency of the quality of image on the contact pressure P and the Young's modulus E was studied. Table 2 below shows the result of the comparative studies of images about Experimental Examples 1 to 7.

TABLE 2

Result of Evaluation of the Image Quality (Color Uneveness Level/Hollow Character Level)

| | Contact Pressure | Young's Modulus [N/m$^2$] of Intermediate Transferring Belt | | | |
|---|---|---|---|---|---|
| | P [N/m$^2$] | $4\times10^6$ | $2\times10^8$ | $2\times10^9$ | $9\times10^9$ |
| Experimental Example 1 | $2.7\times10^4$ | Δ/○ | X/○ | X/○ | X/○ |
| Experimental Example 2 | $3.5\times10^4$ | ○/○ | ○/○ | ○/○ | X/○ |
| Experimental Example 3 | $4.0\times10^4$ | ○/○ | ○/○ | ○/○ | Δ/○ |
| Experimental Example 4 | $4.8\times10^4$ | ○/○ | ○/○ | ○/○ | ○/○ |
| Experimental Example 5 | $6.2\times10^4$ | ○/○ | ○/○ | ○/○ | ○/○ |
| Experimental Example 6 | $7.3\times10^4$ | ○/○ | ○/Δ | ○/Δ | ○/Δ |
| Experimental Example 7 | $8.0\times10^4$ | ○/○ | ○/X | ○/X | ○/X |

The evaluation of the image color unevenness level in Table 2 was effected by evaluating the color unevenness of a blue (magenta and cyan) solid image, and the evaluation of the hollow character image (characters having a white part at the center of the character) level was effected by evaluating the middle blank of a blue (magenta and cyan) line image having a width of 2 mm. The judgment of the above-described image color unevenness level and hollow character image (characters having a white part at the center of the character) level was done by visual organic evaluation, and judgment standards were: ○=no occurrence; Δ=a level practically posing no problem; and X=a clearly seen level.

According to the present studies, the image color unevenness becomes better when the contact pressure P is increased, but the higher was the contact pressure P, the more was seen the occurrence of a hollow character image. Also, the higher was the Young's modulus E, the more aggravated was the image color unevenness.

Here, description will be made of phenomena called the image color unevenness and the hollow character image.

(1) Image Color Unevenness: The image color unevenness is a phenomenon remarkably observed in solid images chiefly of secondary colors such as blue, red and green. For example, in blue, magenta and cyan toner images are in a state in which the cyan toner is superposed on the magenta toner, on the intermediate transferring belt.

The cyan toner superposed on the magenta toner is substantially uniformly transferred onto the transfer material because the magenta toner acts as spacer particles for the intermediate transferring belt. On the other hand, the magenta toner underlying the cyan toner on this intermediate transferring belt partly remains on the intermediate transferring belt at the secondary transferring step due to the adhering force between the magenta toner and the intermediate transferring belt.

If this residual magenta toner becomes non-uniform depending on locations, cyan is substantially uniform in the final blue solid image on the transfer material, whereas magenta becomes non-uniform. Accordingly, an area of a color near to cyan exists in the blue solid image and it is seen as color unevenness.

That is, the image color unevenness is the phenomenon that of toner images of a plurality of colors superposed and formed on the intermediate transferring belt, only a toner image of a color adjacent to the surface side is partly transferred to the transfer material, and this becomes color unevenness.

The inventor thinks as follows about the mechanism of the dependency of this color unevenness on the contact pressure P.

The cause of the occurrence of the color unevenness is considered to reside in that due to the unevenness of the surface of the transfer material, the surface of the transfer material and the surface of the intermediate transferring belt cannot come into close contact with each other, and depending on locations air gaps exist between the surface of the transfer material and the surface of the intermediate transferring belt.

Unless the reversal of the polarity of the toners occurs, the amount of toners transferred from the intermediate transferring belt to the transfer material becomes greater when the transferring electric field applied to the toner layer is greater.

At a location whereat the contact between the surface of the transfer material and the surface of the intermediate transferring belt is bad and an air gap exists between the toner layer on the intermediate transferring belt and the surface of the transfer material, the transferring electric field originally applied to only the toner layer is divided by the air layer, whereby the electric field applied to the toner layer is weakened, and the amount of toners residual on the intermediate transferring belt becomes great. Thereby, the contact state between the surface of the transfer material and the surface of the intermediate transferring belt becomes non-uniform depending on locations, whereby the untransferred toners are also considered to become non-uniform.

Consequently, in the present embodiment, the contact pressure P is increased to crush the unevenness of the surface of the transfer material M to thereby uniformize the contact state between the surface of the transfer material M and the surface of the intermediate transferring belt and uniformize the residual toners on the intermediate transferring belt 1, whereby the color unevenness is improved.

Also the inventor thinks as follows about the mechanism of the dependency of the color unevenness on the Young's modulus E.

The cause of the occurrence of the color unevenness, as described above, is considered to reside in that due to the unevenness of the surface of the transfer material, the surface of the transfer material and the surface of the intermediate transferring belt cannot uniformly come into close contact.

When the Young's modulus of the intermediate transferring belt is high, the surface of the intermediate transferring belt does not follow the unevenness of the surface of the transfer material because the surface of the intermediate transferring belt is hard and therefore, an air gap is formed between the toner layer on the intermediate transferring belt and the surface of the transfer material in a wider area. Thus, it is considered that if the Young's modulus of the intermediate transferring belt is higher, the color unevenness is aggravated.

(2) Hollow Characters Image: The hollow character image is a phenomenon remarkably observed line images chiefly of secondary colors such as blue, red and green.

The magenta and cyan toner images constituting blue are in a state in which the cyan toner is superposed on the magenta toner, on the intermediate transferring belt. If at the secondary transferring step, of the magenta toner underlying the cyan toner on this intermediate transferring belt, chiefly the central portion of the line image is residual on the intermediate transferring belt, whereby in the final line image on the transfer material, the cyan toner is substantially uniform, whereas the magenta toner becomes little at the central portion of the line. Thus, an area of a color near to cyan exists in the central portion of the blue line image, and the central portion of the line image is seen as a blank. This phenomenon is the center blank image.

The reason why the amount of residual toners is particularly great in the central portion of the line image is considered to be that when the toners are compressed by the pressure in the nip between the transfer material and the intermediate transferring belt, pressure is most applied to the central portion of the line and the adhering force between the toners in the central portion becomes particularly high.

The mechanism of the dependency of the center blank image on the contact pressure is considered as follows. The cause of the occurrence of the center blank image resides in that the toners are compressed by the pressure in the nip between the transfer material and the intermediate transferring belt, whereby the adhering force between the toners is increased, and it is considered that as the contact pressure becomes great, the adhering force between the toners is increased, whereby the center blank image level is aggravated.

To adopt a material of low Young's modulus for the intermediate transferring belt, it is necessary to adopt a plural-layer construction, and this complicates the belt manufacturing process and results in the high cost of the belt.

Consequently, in the present invention, for a longer life and lower costs, use is made of an intermediate transferring belt of high hardness, and the present invention is characterized in that without the Young's modulus E of the intermediate transferring belt being lowered, the contact pressure is adjusted to an appropriate value to thereby prevent the color unevenness and center blank phenomena described above.

Accordingly, from the result of the comparative studies shown in Table 2, the inventor has been able to confirm that Experimental Examples 3 to 6 are effective against the color unevenness and the center blank, and the contact pressure P is set to the image of $4.0\times10^4 \leqq P\ [N/m^2] \leqq 7.3\times10^4$, and this is effective to lower the occurrence levels of the color unevenness and center blank image and prevent a faulty image when the Young's modulus of the intermediate transferring belt 1 is $2\times10^8 \leqq E\ [N/m^2] \leqq 9\times10^9$.

Consequently, in the present embodiment, setting is made such that the Young's modulus E of the intermediate transferring belt 1 is within the range of $2\times10^8 \leqq E\ [N/m^2] \leqq 9\times10^9$ and the contact pressure P is within the range of $4.0\times10^4 \leqq P\ [N/m^2] \leqq 7.3\times10^4$.

Thus, the present embodiment can achieve a long life and low costs by using an intermediate transferring belt of high hardness of which the Young's modulus E is $10^8 \leqq E\ [N/m^2] \leqq 9\times10^9$, and even if this intermediate transferring belt of high hardness is used, a faulty image such as the color unevenness or the center of blank can be prevented by setting the contact pressure P between the intermediate transferring belt and the transferring member to the range of $4.0\times10^4 \leqq P\ [N/m^2] \leqq 7.3\times10^4$.

Second Embodiment

A second embodiment of the present invention will now be described. This embodiment is basically similar in construction to the first embodiment, and portions thereof differing from those of the first embodiment will hereinafter be described.

Figure 4:
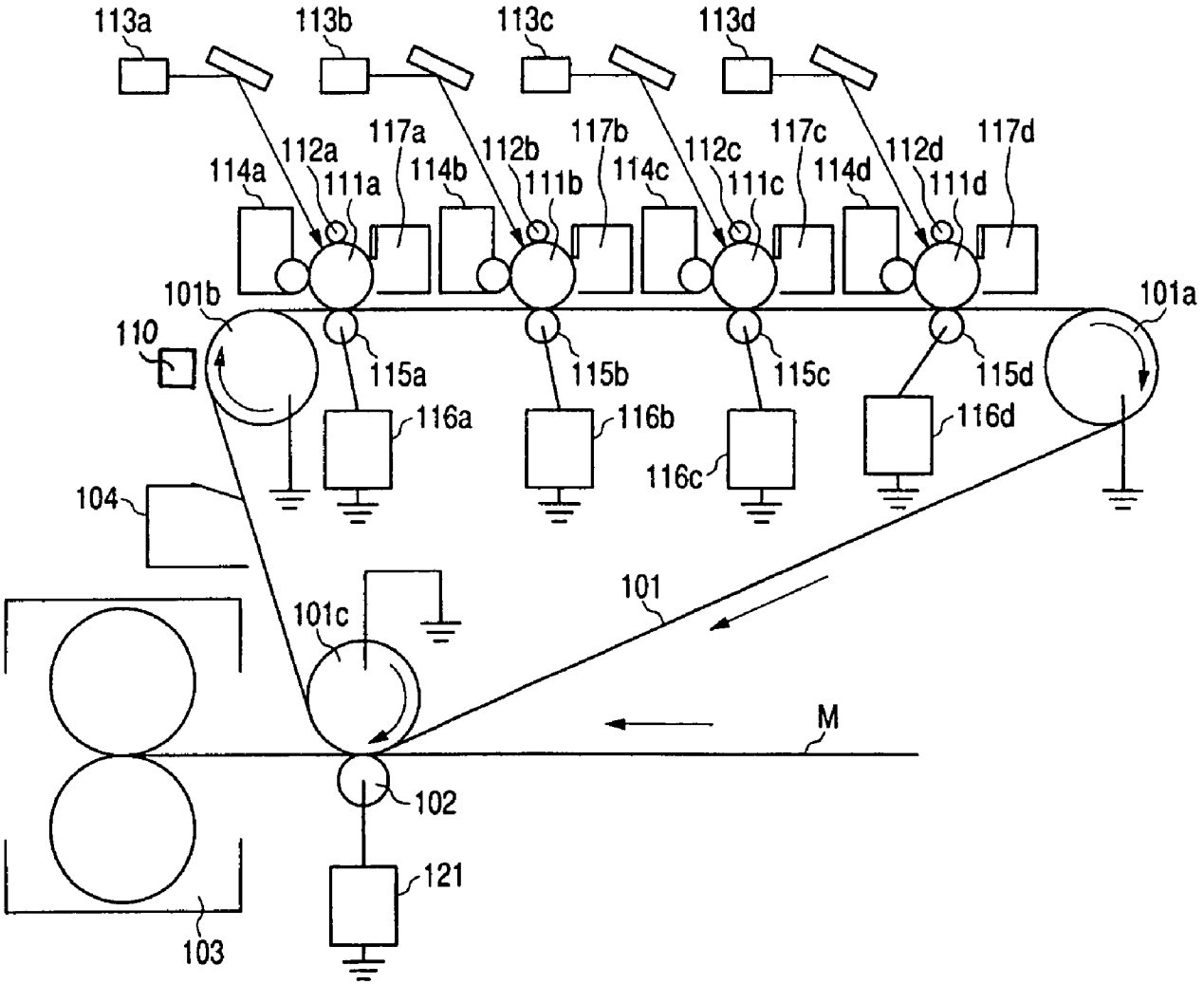
FIG. 4 shows an image forming apparatus which is the background art for the present invention and includes a eliminating member.

As shown in FIG. 4, in the present embodiment, as an intermediate transferring belt 24, use is made of a single-layer endless belt having a circumferential length of 1000 mm and a thickness of 100 μm in which carbon is dispersed in polyimide and both of a toner bearing surface side and a back side are adjusted to surface resistivity $\rho s=1\times10^{12}\ \Omega/\square$.

Also, the Young's modulus E of the intermediate transferring belt 24 is $9\times10^9\ N/m^2$.

The contact pressure P $[N/m^2]$ of the secondary transferring roller 2 against the intermediate transferring belt 24 is $4.8\times10^4\ N/m^2$ as in the first embodiment.

As Experimental Examples 8 to 14, the contact pressure of the secondary transferring roller against the intermediate transferring belt and the surface resistivity of the intermediate transferring belt were changed. The contact pressure was changed from $2.7\times10^4$ to $8.0\times10^4\ N/m^2$. Experimental Example 11 is the present embodiment (the second embodiment).

In the respective experimental examples, as in the case of Experimental Examples 1 to 7, the contacting force F [N] was changed from 30 to 100 [N] and further, the material hardness of the rubber layer of the secondary transferring roller 2 was changed to thereby use two levels 35° and 49° (Asker-C) as the roller hardness, thereby adjusting the contact pressure P.

Also, the amount of carbon dispersed in polyimide was adjusted to thereby change the surface resistivity ρs of the intermediate transferring belt from $1\times10^{6}$ to equal to or greater than $1\times10^{15}$ Ω/□.

The intermediate transferring belt of which the surface resistivity ρs is "equal to or greater than $1\times10^{15}$ Ω/□" has surface resistivity of equal to or greater than $1\times10^{15}$ Ω/□ which is the measurement limit by the background noise of the above-described surface resistivity measuring system and therefore, here it is expressed as equal to or greater than $1\times10^{15}$ Ω/□. The measurement of the surface resistivity was effected by the method described in the first embodiment.

The intermediate transferring belt in each experimental example was a single-layer endless belt having a circumferential length of 1000 mm and a thickness of 100 μm as in the present embodiment.

In Experimental Examples 8 to 14, the dependency of the image quality on the contact pressure P and on the surface resistivity ρs was studied. The result of the comparative studies of an image about the respective experimental examples is shown in Table 3 below.

TABLE 3

| | Result of Evaluation of Image Quality (Color Unevenness Level/Hollow Charcater Level) | | | | | | |
|---|---|---|---|---|---|---|---|
| | | Surface Resistivity ρs Ω/□ | | | | | |
| | Contact Pressure P [N/m$^2$] | $1\times10^{6}$ | $1\times10^{8}$ | $1\times10^{10}$ | $1\times10^{12}$ | $1\times10^{14}$ | Equal to or to or greater than $1\times10^{16}$ |
| Experimental Example 8 | $2.7\times10^{4}$ | X/○ | X/○ | X/○ | X/○ | X/○ | ○/○ |
| Experimental Example 9 | $3.5\times10^{4}$ | X/○ | X/○ | X/○ | X/○ | Δ/○ | ○/○ |
| Experimental Example 10 | $4.0\times10^{4}$ | Δ/○ | ○/○ | ○/○ | ○/○ | ○/○ | ○/○ |
| Experimental Example 11 | $4.8\times10^{4}$ | Δ/○ | ○/○ | ○/○ | ○/○ | ○/○ | ○/○ |
| Experimental Example 12 | $6.2\times10^{4}$ | ○/X | ○/○ | ○/○ | ○/○ | ○/○ | ○/○ |
| Experimental Example 13 | $7.3\times10^{4}$ | ○/Δ | ○/Δ | ○/Δ | ○/Δ | ○/Δ | ○/○ |
| Experimental Example 14 | $8.0\times10^{4}$ | ○/X | ○/X | ○/X | ○/X | ○/X | ○/X |

According to the present studies, the color unevenness became good when the contact pressure was increased, and the higher was the surface resistivity ρs of the intermediate transferring belt, the better became the color unevenness.

Also, in an intermediate transferring belt of $1\times10^{6}$ Ω/□, it never happened that even if the contact pressure was increased, good color unevenness and hollow characters were compatible.

An intermediate transferring belt of equal to or greater than $1\times10^{15}$ Ω/□ is great in the time constant of charge attenuation and charges imparted to the surface thereof are residual thereon and therefore, during image forming, a corona charger 110, was installed at a location on the intermediate transferring belt downstream of the cleaning blade 4 and upstream of the photosensitive drum 11*a* for the first color, and an image forming was effected while applying an AC bias of 10 $kV_{pp}$, 1 kHz and sine wave to thereby eliminate the residual charges on the intermediate transferring belt.

The judgment of the image color unevenness and center blank image levels in Table 3 was effected in a manner similar to that described in the first embodiment. The inventor thinks as follows about the mechanism of the dependency of the color unevenness on the surface resistivity ρs.

The cause of the occurrence of the color unevenness is considered to be that the amount of toners residual on the intermediate transferring belt is great at locations whereat due to the unevenness of the surface of the transfer material, the surface of the transfer material and the surface of the intermediate transferring belt cannot uniformly come into close contact with each other and air gaps exist between the surface of the transfer material and the surface of the intermediate transferring belt.

By heightening the surface resistivity ρs, the difference in the transferring electric field applied to the toner layer in areas wherein the air gaps exist and areas wherein the air gaps do not exist can be made small, and the difference in the amount of untransferred toners in the areas wherein the air gaps exist and the areas wherein the air gaps do not exist can be made small. Thereby, the residual toners on the intermediate transferring belt become uniform and the color unevenness is improved.

From the above-described result of the comparative studies, the inventor has been able to confirm that Experimental Examples 10 to 13 are effective for the color unevenness and the center blank and in a case where the surface resistivity ρs Ω/□ of the intermediate transferring belt is $1\times10^{8}\leqq\rho s\leqq1\times10^{15}$, the occurrence level of the color unevenness and the center blank image can be rendered into a level which practically poses no problem, by setting the contact pressure P [N/m$^2$] to the range of $4.0\times10^{4}\leqq P\leqq7.3\times10^{4}$, without having any special residual charge eliminating device for the intermediate transferring belt.

Consequently, in the present embodiment, setting is done such that the surface resistivity ρs Ω/□ of the intermediate transferring belt 24 is $1\times10^{8}\leqq\rho s\leqq1\times10^{15}$ and the contact pressure P [N/m$^2$] is within the range of $4.0\times10^{4}\leqq P\leqq7.3\times10^{4}$.

As described in the first embodiment, again in the present embodiment, the occurrence of the color unevenness and the center blank can be suppressed even if the Young's modulus E of the intermediate transferring belt is high hardness of $2\times10^8 \leqq E \leqq 9\times10^9$.

While in the above-described embodiments, the intermediate transferring belt has been described with respect to a single-layer one, the present invention is also applicable to an intermediate transferring belt having a plurality of layers having a Young's modulus of high hardness on at least the surface layer thereof adjacent to the transferring member.

While in the afore-described embodiments, a color laser printer having photosensitive members which are image bearing members for four colors has been described by way of example as the image forming apparatus, the present invention is not restricted thereto, but may be an image forming apparatus such as facsimile apparatus or a cpopying machine, and the number of the photosensitive mebers may be one. The present invention is nor restricted to a color image forming apparatus, but is also applicable to an apparatus having a single image bearing member and effecting single-color image formation.

Also, while in the aforedescribed embodiments, description has been made of a case where an intermediate transferring belt is utilized as an image bearing member, a secondary transferring roller is utilized as a transfer member for transferring a formed image to a transfer material, and the image is secondary-transferred from the intermediate transferring belt to the transfer material, the present invention is not restricted thereto, but may also be applied to a transfer member utilizing a photosensitive drum or a photosensitive belt as an image bearing member, and transferring a formed image to other medium such as atransfer material or an intermediate transferring member. Accordingly, the present invention can also be applied in an image forming apparatus provided with no intermediate transferring member.

As described in the first embodiment and the second embodiment, there can be provided an image forming apparatus in which the contact pressure P [$N/m^2$] between a transfer member such as a transferring roller and an image bearing member such as an intermediate transferring belt is set to $4.0\times10^4 \leqq P \leqq 7.3\times10^4$ to thereby prevent color unevenness and hollow characters even if use is made of an image bearing member of a long life and low costs and a transferring member of low hardness. In this case, the center blank and the color unevenness can be prevented even if the surface resistance of the image bearing member is relatively high.

As described above, the image forming apparatus of the present invention enables an image bearing member and a transfer member to be applied thereto in a wide range, and the present invention can provide an image forming apparatus of low costs and a long life which prevents the image color unevenness and the image hollow character in the image forming process even if use is made of an image bearing member of high hardness.

While the embodiments of the present invention have been described above, the present invention is in no way restricted to the above-described embodiments, and all modifications are possible within the technical idea of the present invention.

What is claimed is:

1. An image forming apparatus comprising:

an image bearing member bearing a toner image thereon; and an intermediate transfer member contacting with said image bearing member in a contact portion, wherein the toner image on said image bearing member is transferred to transfer medium by said intermediate transfer member, a Young's modulus of said image bearing member is equal to or greater than $2\times10^8$ $N/m^2$ and equal to or less than $9\times10^9$ $N/m^2$, and contact pressure between said image bearing member and said intermediate transfer member in said contact portion is equal to or greater than $4.0\times10^4$ $N/m^2$ and equal to or less than $73\times10^4$ $N/m^2$.

2. An image forming apparatus according to claim 1, wherein a surface resistivity of said image bearing member is equal to or greater than $1\times10^8$ Ω/□ and equal to or less than $1\times10^{15}$ Ω/□.

3. An image forming apparatus according to claim 1, wherein said image bearing member is a photosensitive member, and said transfer medium is a transfer material.

4. An image forming apparatus comprising:

an image bearing member for bearing a toner image:

an intermediate transfer member which is movable in a moving direction and contacts said image bearing member at a contact portion;

a cleaning member opposed to said movable intermediate transfer member, for cleaning toner on said intermediate transfer member; and a charge elimination member opposed to said intermediate transfer member and positioned upstream of the contact portion and downstream of said cleaning member in the moving direction of said intermediate transfer member, for executing a charge elimination of said intermediate transfer member, wherein the toner image on said image bearing member is transferred to a transfer material by said intermediate transfer member, a surface resistivity of said image bearing member is equal to or greater than $1\times10^{15}$ Ω/□, and a contact pressure between said image bearing member and said intermediate transfer member at the contact portion is equal to or greater than $2.7\times10^4$ $N/m^2$ and equal to or less than $7.3\times10^4$ $N/m^2$.

5. An image forming apparatus according to claim 4, wherein said intermediate transfer member comprises a single layer belt.

* * * * *

UNITED STATES PATENT AND TRADEMARK OFFICE

CERTIFICATE OF CORRECTION

PATENT NO. : 7,043,183 B2
APPLICATION NO. : 10/626534
DATED : May 9, 2006
INVENTOR(S) : Yasuo Yoda et al.

It is certified that error appears in the above-identified patent and that said Letters Patent is hereby corrected as shown below:

COLUMN 1

Line 58, “fer” should read --ferring--; and
Line 65, “transfer” should read --transferring--.

COLUMN 2

Line 43, “diameter” should read --diameter of--.

COLUMN 3

Line 21, “case where” should read --case wherein--.

COLUMN 4

Line 9, “a toner image; an intermediate” should read --an image thereon, and a transferring member contacting with the image bearing member in a contact portion, and in which the image on the image bearing member is transferred to a transfer medium in the contact portion by the--;

Lines 10-19, “transfer member which is movable in a moving direction and contacts the image bearing member at a contact portion; a cleaning member opposed to the movable intermediate transfer member, for cleaning toner on the intermediate transfer member; and a charge elimination member opposed to the intermediate transfer member and positioned upstream of the contact portion and downstream of the cleaning member in the moving direction of the intermediate transfer member, wherein the toner image on the image bearing member is transferred to a transfer material by the interme” should be deleted;

Line 22, “diate” should be deleted;
Line 28, “an a toner” should read --a toner--; and
Line 59, “eliminating” should read --charge eliminating--.

COLUMN 7

Line 45, “resistivityρs” should read --resistivity--; and
Line 56, “$1x10^8\Omega$.” should read --$1x10^8\Omega$/ .--.

COLUMN 8

Line 25, “W was” should read --W was set to--.

COLUMN 9

Line 16, “weak to fracture” should read --subject to fracture--;
Line 45, (Table 2), “Uneveness” should read --Unevenness--; and
Line 46, (Table 2), “[$N/m^2$]” should read --E [$N/m^2$]--.

UNITED STATES PATENT AND TRADEMARK OFFICE

CERTIFICATE OF CORRECTION

PATENT NO. : 7,043,183 B2
APPLICATION NO. : 10/626534
DATED : May 9, 2006
INVENTOR(S) : Yasuo Yoda et al.

It is certified that error appears in the above-identified patent and that said Letters Patent is hereby corrected as shown below:

COLUMN 11

Line 38, “step,” should read --step--.

COLUMN 13

Table 3, “Charcater” should read --Character--; and

Line 59, “110,” should read --110--.

COLUMN 15

Line 10, “afore-described” should read --aforedescribed--;

Line 15, “facsimile” should read --a facsimile--; and “cpopying” should read --copying--;

Line 16, “mebers” should read --members--;

Line 17, “is nor” should read --is not--; and

Line 31, “other” should read --another--, and “atransfer” should read --a transfer--.

COLUMN 16

Line 13, “transfer” should read --a transfer--; and

Line 20, “$73x10^4N/m^2$.” should read --$7.3x10^4N/m^2$.--.

Signed and Sealed this

Nineteenth Day of December, 2006

JON W. DUDAS
*Director of the United States Patent and Trademark Office*